US007765801B2

(12) United States Patent
Hill, Jr. et al.

(10) Patent No.: US 7,765,801 B2
(45) Date of Patent: Aug. 3, 2010

(54) EXHAUST GAS TREATMENT DEVICE WITH INSULATED HOUSING CONSTRUCTION

(75) Inventors: Frederick B. Hill, Jr., Clarkston, MI (US); Joseph G. Salmonowicz, Jr., Lapeer, MI (US); Brad M. Schneemann, Grand Blanc, MI (US); John C. Studabaker, Grand Blanc, MI (US)

(73) Assignee: Benteler Automotive Corporation, Auburn Hills, MI (US)

( * ) Notice: Subject to any disclaimer, the term of this patent is extended or adjusted under 35 U.S.C. 154(b) by 1281 days.

(21) Appl. No.: 11/290,495

(22) Filed: Nov. 30, 2005

(65) Prior Publication Data

US 2007/0119156 A1 May 31, 2007

(51) Int. Cl.
*F01N 3/10* (2006.01)

(52) U.S. Cl. ..... 60/302; 60/276; 60/299

(58) Field of Classification Search ..... 60/274, 60/302, 299, 307, 276; 29/890, 505, 515; 422/171, 172, 177, 179, 180
See application file for complete search history.

(56) References Cited

U.S. PATENT DOCUMENTS

| | | | | |
|---|---|---|---|---|
| 4,049,388 | A | 9/1977 | Scheitlin et al. | |
| 4,238,456 | A * | 12/1980 | Jalbing | 422/172 |
| 4,425,304 | A * | 1/1984 | Kawata et al. | 422/171 |
| 5,094,072 | A * | 3/1992 | Ampferer et al. | 60/290 |
| 5,173,267 | A | 12/1992 | Maus et al. | |
| 5,190,732 | A | 3/1993 | Maus et al. | |
| 5,220,789 | A | 6/1993 | Riley et al. | |
| 5,331,810 | A | 7/1994 | Ingermann et al. | |
| 6,128,821 | A | 10/2000 | Grescher | |
| 6,334,981 | B1 * | 1/2002 | Wieres | 422/177 |
| 6,555,070 | B1 | 4/2003 | Kruger | |
| 6,899,853 | B1 * | 5/2005 | Diez et al. | 422/179 |
| 7,276,213 | B2 * | 10/2007 | Barron et al. | 422/179 |
| 7,384,613 | B2 * | 6/2008 | Prommersberger et al. | 422/179 |
| 2002/0150518 | A1 | 10/2002 | Brush et al. | |
| 2004/0109795 | A1 | 6/2004 | Marc | |
| 2004/0170540 | A1 | 9/2004 | Barron et al. | |

FOREIGN PATENT DOCUMENTS

| | | | |
|---|---|---|---|
| EP | 0992659 | A2 | 4/2000 |
| FR | 2821117 | A1 | 8/2002 |
| JP | 08296436 | | 11/1996 |
| WO | WO 2005/098210 | A1 | 10/2005 |

* cited by examiner

*Primary Examiner*—Tu M Nguyen
(74) *Attorney, Agent, or Firm*—Price, Heneveld, Cooper, DeWitt & Litton, LLP

(57) ABSTRACT

An exhaust gas treatment device for internal combustion engines and the like includes inlet and outlet end caps, two catalyst substrates, and a two-piece housing. A first, cylindrically-shaped housing member has a hollow interior in which one of the substrates is retained, a first end sealingly connected with the inlet end cap, and an opposite second end with a radially reduced section. A second cylindrically-shaped housing member has a hollow interior in which the other one of the substrates is retained, a first end sealingly connected with the outlet end cap, and an opposite second end with a radially enlarged section sized to receive therein the second end of the first housing member, whereby the reduced section of the first housing member and the enlarge section of the second housing member are spaced radially apart a predetermined distance to define an annularly-shaped space or gap which thermally insulates the associated portion of the exhaust gas treatment device.

51 Claims, 3 Drawing Sheets

EXHAUST GAS TREATMENT DEVICE WITH INSULATED HOUSING CONSTRUCTION

BACKGROUND OF THE INVENTION

The present invention relates to exhaust gas treatment devices for internal combustion engines and the like, and in particular to an insulated housing construction therefor.

Exhaust gas treatment devices, such as catalytic converters, evaporative emission devices, hydrocarbon scrubbing components and the like, are well known in the art, and are used to treat exhaust gas from internal combustion engines, such as those associated with automobiles, trucks, boats and other vehicles. These exhaust gas treatment devices typically employ catalysts supported by substrates in a housing to catalytically treat the stream of exhaust gas. Due to the high temperature of the exhaust gas, and the normally preferred hot operating temperature of the exhaust gas treatment mechanism, such devices are usually separated or otherwise thermally insulated from adjacent components of the vehicle.

A combination exhaust manifold and catalytic converter, or "maniverter", such as that disclosed in U.S. Pat. No. 6,555,070, has been developed for use in automobiles, wherein the component is positioned within the engine compartment of the vehicle. While maniverters provide a very compact construction, they are relatively expensive to manufacture, and emit substantial additional heat in the engine compartment, and therefore must include some form of heat shield to prevent degradation and/or damage to adjacent components of the vehicle. Metal shields, mounting brackets and fasteners, etc. have been used to shield the heat of prior art exhaust treatment devices, particularly in two-stage or dual substrate configurations, wherein the medial portions of the devices, through which the gas sensors extend, normally have a single wall construction, and are not internally insulated from adjacent components in the engine compartment of the vehicle. While such devices do reduce some radiation heat transfer, they are not very effective in reducing convection heat transfer. Because the gas sensors associated with exhaust gas treatment devices typically protrude radially outwardly from the components, the associated areas of the housing members are difficult to shield from heat transfer to adjacent vehicle components.

Hence, the need exists for an exhaust gas treatment device which has a compact size, efficiently and effectively treats exhaust gas emissions, is thermally insulated, and has an uncomplicated construction which is economical to manufacture.

SUMMARY OF THE INVENTION

One aspect of the present invention is an exhaust gas treatment device for internal combustion engines and the like, comprising an inlet end cap configured for communication with incoming exhaust gas, an outlet end cap configured for communication with exiting exhaust gas, first and second substrates adapted to treat exhaust gas flowing through the exhaust gas treatment device, and a gas sensor adapted to measure at least one characteristic of exhaust gas flowing through the exhaust gas treatment device. The exhaust gas treatment device also includes a cylindrically-shaped first housing member having a hollow interior receiving and retaining therein the first substrate, a first end thereof operably connected with the inlet end cap to form an airtight seal therebetween, and an opposite second end with a radially reduced section having a first radially extending aperture configured to receive a portion of the gas sensor therethrough.

The exhaust gas treatment device also includes a cylindrically-shaped second housing member having an interior receiving and retaining therein the second substrate, a first end thereof operably connected with the outlet end cap to form an airtight seal therebetween, and an opposite second end thereof with a radially enlarged section having a second radially extending aperture aligned with the first aperture and configured to receive a portion of the gas sensor therethrough. The enlarged section is sized to receive a second end of the first housing member therein to form an airtight seal therebetween, whereby the reduced section of the first housing member and the enlarged section of the second housing member are spaced radially apart a predetermined distance to define therebetween an annularly-shaped space which thermally insulates an associated portion of the exhaust gas treatment device.

Another aspect of the present invention is a maniverter for vehicles having an internal combustion engine, comprising an exhaust manifold configured for operative connection with the internal combustion engine to route exhaust gas therefrom, an inlet end cap operably connected with the exhaust manifold and communicating with incoming exhaust gas, an outlet end cap adapted for operative connection with an exhaust pipe portion of the vehicle and communicating with exiting exhaust gas, first and second substrates adapted to treat exhaust gas flowing through the maniverter, and a gas sensor adapted to measure at least one characteristic of exhaust gas flowing through the maniverter. The maniverter further includes a cylindrically-shaped first housing member having a hollow interior receiving and retaining therein the first substrate, a first end thereof operably connected with the inlet end cap to form an airtight seal therebetween, and an opposite second end with a radially reduced section having a first radially extending aperture configured to receive a portion of the gas sensor therethrough. The maniverter further includes a cylindrically-shaped second housing member having an interior receiving and retaining therein the second substrate, a first end thereof operably connected with the outlet end cap to form an airtight seal therebetween, and an opposite second end with a radially enlarged section having a second radially extending aperture aligned with the first aperture and configured to receive a portion of the gas sensor therethrough. The enlarged section is sized to receive the second end of the first housing member therein to form an airtight seal therebetween, whereby the reduced section of the first housing member and the enlarged section of the second housing member are spaced radially apart a predetermined distance to define therebetween an annularly-shaped space which thermally insulates an associated portion of the maniverter.

Yet another aspect of the present invention is an exhaust gas treatment device for internal combustion engines and the like, comprising an inlet end cap configured for communication with incoming exhaust gas, an outlet end cap configured for communication with exiting exhaust gas, and first and second substrates adapted to treat exhaust gas flowing through the exhaust gas treatment device. The exhaust gas treatment device further includes a cylindrically-shaped first housing member having a hollow interior receiving and retaining therein the first substrate, a first end operably connected with the one of the inlet end cap and the outlet end cap to form an airtight seal therebetween, and an opposite second end with a radially reduced section. The exhaust gas treatment device further includes a cylindrically-shaped second housing member having an interior receiving and retaining therein the second substrate, a first end thereof operably connected with the one of the inlet end cap and the outlet end cap to form an airtight seal therebetween, and an opposite second end thereof with a radially enlarged section sized to receive the second end of the first housing member therein to form an airtight seal therebetween, whereby the reduced section of the first housing member and the enlarged section of the second housing member are spaced radially apart a predetermined distance to define therebetween an annularly-shaped space which thermally insulates an associated portion of the exhaust gas treatment device.

Yet another aspect of the present invention is a method for making an exhaust gas treatment device for internal combustion engines and the like, comprising forming an inlet end cap configured for communication with incoming exhaust gas, forming an outlet end cap configured for communication with exiting exhaust gas, providing first and second substrates adapted to treat exhaust gas flowing through the exhaust gas treatment device, and providing a gas sensor adapted to measure at least one characteristic of exhaust gas flowing through the exhaust gas treatment device. The method further includes forming a cylindrically-shaped first housing member with a hollow interior, a first end shaped for operable connection with the inlet end cap, a second end having a radially reduced section, and a first radially extending aperture configured to receive a portion of the gas sensor therethrough. The method further includes positioning the first substrate in the interior of the first housing member, and connecting the first end of the first housing member with the inlet end cap to form an airtight seal therebetween. The method further includes forming a cylindrically-shaped second housing member with a hollow interior, a first end shaped for operable connection with the outlet end cap, a second end having a radially enlarged section, and a second radially extending aperture configured to receive a portion of the gas sensor therethrough. The method further includes positioning the second substrate in the interior of the second housing member, and connecting the first end of the second housing member with the outlet end cap to form an airtight seal therebetween. The method further includes positioning the enlarged section on the second housing member telescopingly over the second end of the first housing member, such that the first and second apertures are radially aligned, and then forming an airtight seal between the enlarged section on the second housing member and second end of the first housing member, whereby the reduced section of the first housing member and the enlarged section of the second housing member are spaced radially apart a predetermined distance to define therebetween an annularly-shaped space which thermally insulates an associated portion of the exhaust gas treatment device.

Yet another aspect of the present invention is to provide an exhaust gas treatment device which has a compact size, efficiently and effectively treats exhaust gas, is thermally insulated, and has an uncomplicated construction which is economical to manufacture. The exhaust gas treatment device has relatively few parts which are constructed to fit together in a unique fashion to provide structural integrity and superior thermal insulation. The exhaust gas treatment device reduces heat loss or thermal transfer to the engine compartment, and is particularly effective in reducing convection heat transfer from the surface of the exhaust gas treatment device. In dual substrate configurations, an annularly-shaped space or air gap is formed between the substrates where the gas sensor is positioned, so as to provide thermal insulation in an area that would normally otherwise be uninsulated. The exhaust gas treatment device is efficient in use, capable of a long operating life, and particularly well adapted for the proposed use.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
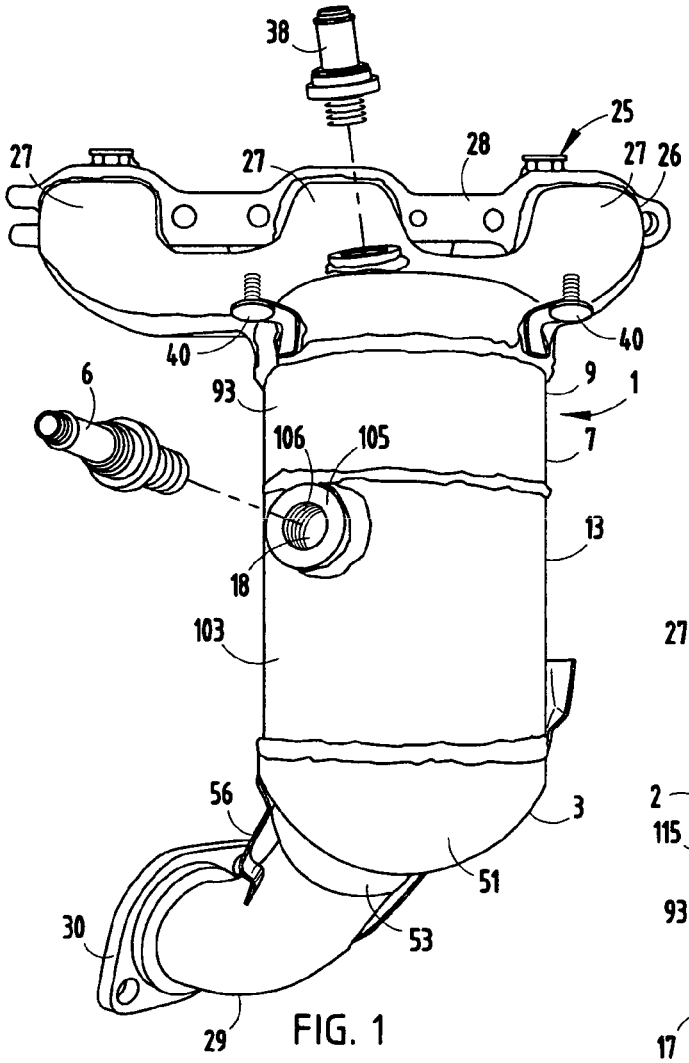
FIG. 1 is a fragmentary perspective view of a maniverter incorporating an exhaust gas treatment device embodying the present invention, wherein gas sensor portions of the maniverter are exploded away to reveal internal construction.
Figure 2:
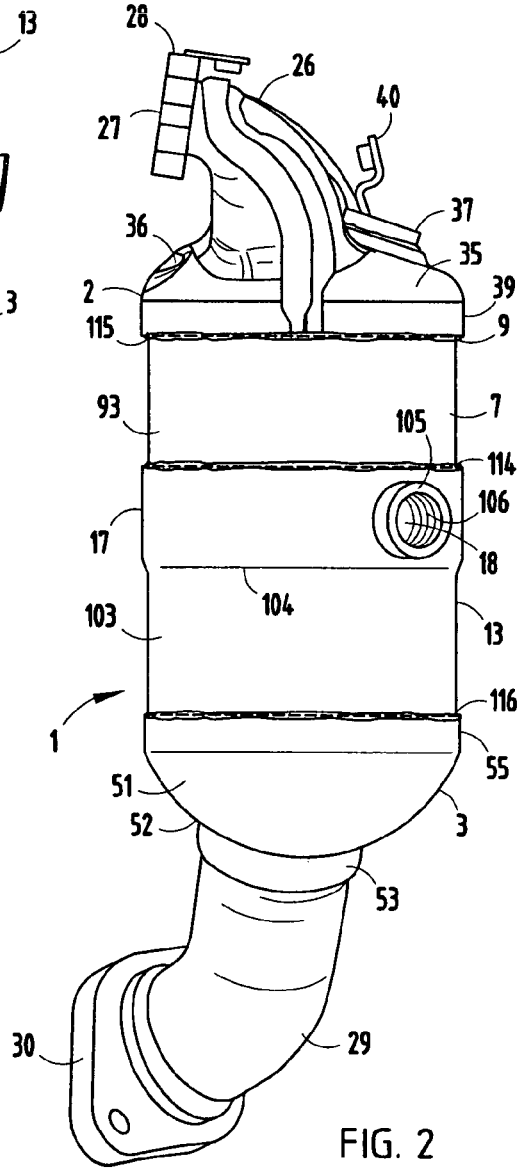
FIG. 2 is a side elevational view of the maniverter, shown with the gas sensors removed.

For purposes of description herein, the terms "upper", "lower", "right", "left", "rear", "front", "vertical", "horizontal" and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
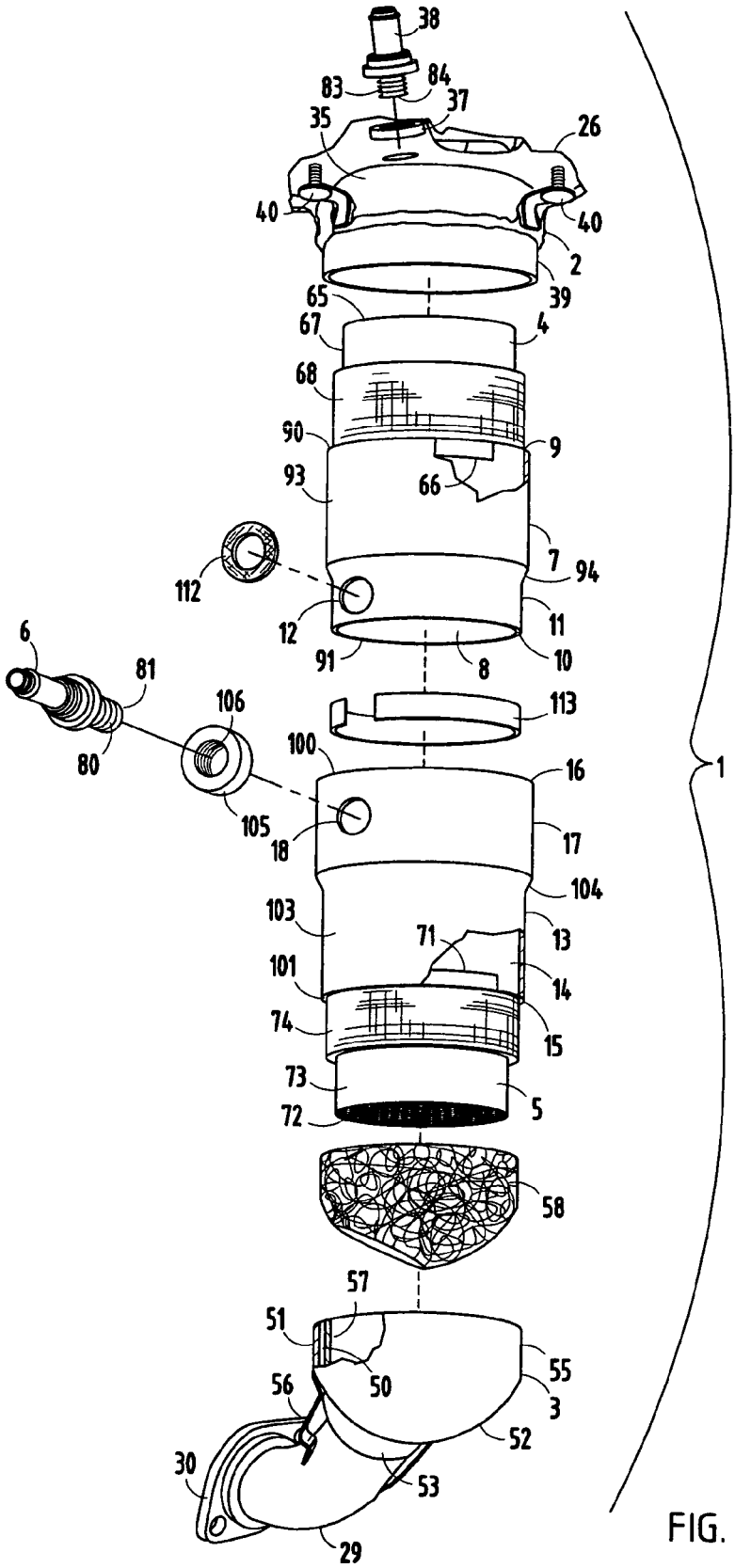
FIG. 3 is an exploded perspective view of the exhaust gas treatment device.

The reference numeral 1 (FIG. 1) generally designates an exhaust gas treatment device embodying the present invention. As best illustrated in FIG. 3, exhaust gas treatment device 1 includes an inlet end cone or cap 2 configured for communication with incoming exhaust gas, and an outlet end cone or cap 3 configured for communication with exiting exhaust gas. First and second substrates 4 and 5 are provided to treat exhaust gas flowing through exhaust gas treatment device 1, and a gas sensor 6 is provided to measure at least one characteristic of the exhaust gas flowing through exhaust gas treatment device 1. Exhaust gas treatment device 1 also includes a cylindrically-shaped first housing member 7 having a hollow interior 8 receiving and retaining therein first substrate 4, a first end 9 operably connected with the inlet end cone 2 to form an airtight seal therebetween, and an opposite second end 10 with a radially reduced section 11 having a first radially extending aperture 12 configured to receive a portion of gas sensor 6 therethrough. Exhaust gas treatment device 1 also includes a cylindrically-shaped second housing member 13 having an interior 14 receiving and retaining second substrate 5 therein, a first end 15 operably connected with outlet end cone 3 to form an airtight seal therebetween, and an opposite second end 16 with a radially enlarged section 17 having a second radially extending aperture 18 aligned with first aperture 12 and configured to receive a portion of gas sensor 6 therethrough. Enlarged section 17 is sized to receive the second end 10 of first housing member 7 therein to form an airtight seal therebetween, whereby the reduced section 11 of first housing member 7 and the enlarged section 17 of second housing member 13 are spaced radially apart a predetermined distance to define therebetween an annularly-shaped space or air gap 19 (FIG. 4) which thermally insulates an associated portion of exhaust gas treatment device 1.

In the example illustrated in FIGS. 1 and 2, exhaust gas treatment device 1 is incorporated into a maniverter 25, which includes an exhaust manifold 26 with three inlet port portions 27, and is connected with the valve head (not shown) of an associated internal combustion engine through a bolt flange 28. In the illustrated example, exhaust manifold 26 is formed integrally in inlet end cone 2, as described in greater detail hereinafter. Maniverter 25 also includes an outlet pipe 29 which is connected with outlet end cone 3 at one end, and includes a connector flange 30 at the opposite end for attachment to an exhaust pipe (not shown). Maniverter 25 is adapted to fit within the engine compartment of an associated vehicle, and treat exhaust gases emitted from the associated internal combustion engine (not shown).

With reference to FIGS. 1-4, the illustrated inlet end cap or cone 2 is disposed at the upper end of the exhaust gas treatment device 1, and has a single wall, two-piece clamshell construction which is integrally formed with exhaust manifold 26. More specifically, the illustrated inlet end cone 2 has front and rear halves 35 and 36 (FIG. 2) which are joined integrally together on opposite sides of exhaust manifold 26 by means such as welding or the like. The upper portion of front half 35 is rounded, and includes an annularly-shaped boss 37 with a threaded interior aperture that is aligned with an associated aperture in the front half 35 of inlet end cone 2 to receive therein a second gas sensor 38 for purposes to be described in greater detail hereinafter. The lower portions of inlet end cone halves 35 and 36 are shaped to define a cylindrically-shaped collar 39 sized to closely receive end 9 of housing member 7 therein. A pair of heat shield tabs 40 are mounted on inlet end cone 2 for purposes described below.

The illustrated outlet end cap or cone 3 (FIG. 4) is located at the lower end of exhaust gas treatment device 1, and has a dual wall construction defined by first and second radially spaced apart walls 50 and 51. Outer wall 51 has a generally arcuate or hemispherical lower portion 52 with an outlet collar 53 (FIGS. 1-3) depending therefrom, which is sized to mate with outlet pipe 29. The upper portion of outlet end cone 3 forms a circular collar 55, which is similar to the collar 39 on inlet end cone 2, and is adapted to receive end 15 of housing member 13 therein. A heat shield 56 is attached to outer wall 51 for purposes to be described in greater detail hereinafter. The inner wall 50 (FIG. 4) of outlet end cone 3 is spaced radially apart a predetermined distance from outer wall 51 to define a bowl-shaped cavity 57 which serves to thermally insulate the lower portion of exhaust gas treatment device 1. In the illustrated example, an insulator mat 58 is positioned in cavity 57 to even further reduce heat transfer from the lower portion of exhaust gas treatment device 1.

With reference to FIG. 3, the illustrated substrates 4 and 5 have a substantially identical construction, and are spaced axially apart within the interior of exhaust gas treatment device 1. Each of the substrates has a generally cylindrical shape, and a conventional honeycomb interior construction. More specifically, substrate 4 includes a circular upper surface 65 facing inlet end cone 2, a circular lower surface 66 facing a medial portion of exhaust gas treatment device 1, and a cylindrical outer surface 67 which is positioned concentric with the interior of housing member 7 and spaced radially apart therefrom a predetermined distance. A conventional insulating support mat 68 is wrapped around the outer surface 67 of substrate 4. In like manner, substrate 5 is defined by a circular upper surface 71 which faces the medial portion of exhaust gas treatment device 1, a circular lower surface 72 which faces outlet end cone 3, and a cylindrical outer surface 73 which is positioned concentric with housing member 13 and spaced radially apart therefrom. A conventional insulating support mat 74 is wrapped around the outer surface 73 of substrate 5.

As best illustrated in FIG. 3, both gas sensors 6 and 38 have a substantially conventional construction, and are adapted to measure at least one characteristic of the exhaust gas flowing through exhaust gas treatment device 1. Gas sensor 6 may be particularly adapted to detect levels of oxygen, nitrogen oxide, and other similar elements in the exhaust gas. Gas sensor 6 has a threaded medial portion 80 to facilitate mounting the same within exhaust gas treatment device 1, as well as an outer tip portion 81 which is designed to extend into the path of the exhaust gas to detect selected characteristics thereof. Similarly, gas sensor 38 includes a threaded medial portion 83 and an outer tip 84.

Figure 4:
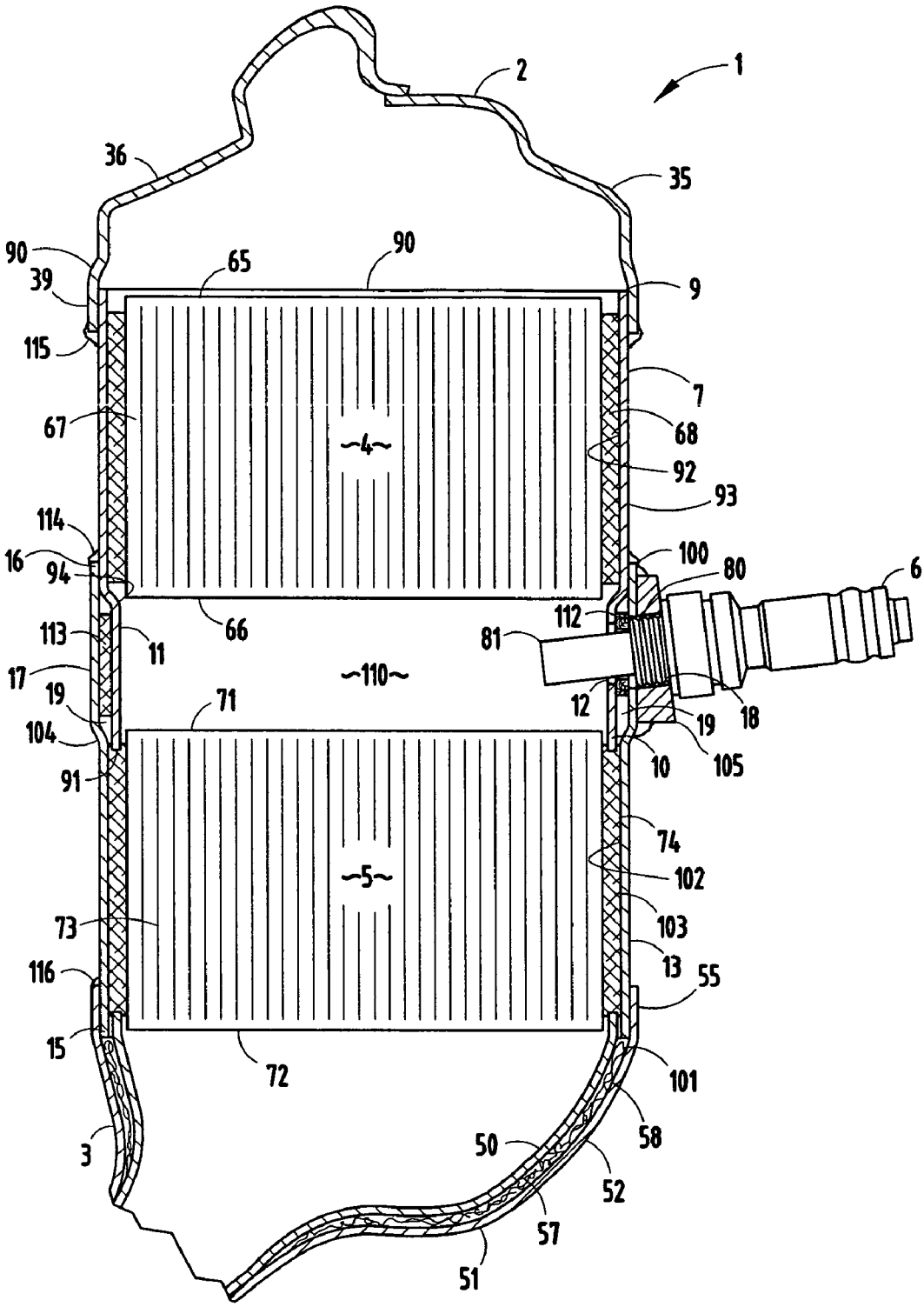
FIG. 4 is a vertical cross-sectional view of the exhaust gas treatment device.

With reference to FIGS. 3 and 4, the illustrated first housing member 7 is positioned at the upper end of exhaust gas treatment device 1, and has a cylindrical shape defined by annular upper and lower ends 90 and 91 respectively, and cylindrical inner and outer surfaces 92 and 93 respectively. In the illustrated example, radially reduced section 11 is formed integrally in upper housing member 7, is located at the lower end thereof, and has a curved or arcuate neck portion 94 which transitions into the body of upper housing member 7. The outer surface 93 of upper housing member 7 at the upper end thereof is shaped to be closely received within the interior of the collar portion 39 of inlet end cone 2, and is attached thereto to form an airtight seal therebetween in the manner discussed hereinbelow. The inside surface 92 of upper housing member 7 is sized to closely receive therein substrate 4 with support mat 68 wrapped thereabout, so as to securely retain substrate 4 and support mat 68 within the interior 8 of upper housing member 7.

With reference to FIGS. 3 and 4, the illustrated second housing member 13 is located at the lower end of exhaust gas treatment device 1, and has a cylindrical shape defined by annular upper and lower ends 100 and 101, as well as cylindrical inner and outer surfaces 102 and 103 respectively. The illustrated enlarged section 17 is integrally formed in lower housing member 13 at the upper end thereof, and has a curved or arcuate neck portion 104 which transitions into the body of lower housing member 13. The outer surface 103 of lower housing member 13 at the lower end thereof is shaped to be closely received within the collar portion 55 of outlet end cone 3 to form an airtight seal therebetween in the manner discussed in greater detail hereinafter. The inner surface 102 of lower housing member 13 is sized to closely receive therein substrate 5 with support mat 74 wrapped thereabout, so as to securely retain substrate 5 and support mat 74 within the interior 14 of lower housing member 13.

As best illustrated in FIG. 4, the enlarged section 17 on lower housing member 13 is sized to closely receive therein upper housing member 7 at a location disposed above reduced section 11 and is operably connected therewith, so as to form an airtight seal therebetween in the manner discussed in greater detail below. The reduced section 11 of upper housing member 7 and the enlarged section 17 of lower housing member 13 are spaced radially apart a predetermined distance to provide a double wall construction, and define therebetween annularly-shaped space or air gap 19, which thermally insulates the associated portion of exhaust gas treatment device 1. In the illustrated example, the upper end 100 of lower housing member 13 is welded to the outer surface 93 of upper housing member 7 at a location immediately above the neck portion 94 of reduced section 11. The lower end 91 of reduced section 11 is positioned radially adjacent to the interior surface 102 of lower housing member 13 adjacent the neck portion 104 of enlarged section 17. The space between the outside surface of lower edge 91 and the inside surface of lower housing 13 is sufficient to effectively close off space 19 to define an insulating air gap therebetween. In the illustrated example of the present invention, the lower end 91 of upper housing member 7 abuts and extends slightly into the support mat 74 surrounding substrate 5, so as to form a seal which more fully closes off space or air gap 19. In one working example of the present invention, insulating space 19 has a radially measured width of around five millimeters, although it is to be understood that other shapes and sizes may be used to accommodate a particular application. A boss 105 with a threaded interior 106 is rigidly attached to the outer surface 103 of lower housing member 13 over aperture 18, which in the assembled condition, is radially aligned with aperture 12. The interior 106 of boss 105 is adapted to threadedly receive and retain gas sensor 6 therein.

As best illustrated in FIG. 4, a cylindrical space or gap 110 is formed between the adjacent ends 66 and 71 of substrates 4 and 5. In the illustrated example, gap 110 is located at a medial portion of exhaust gas treatment device 1. However, it is to be understood that gap 110 may be positioned at different locations along exhaust gas treatment device 1, depending upon the shape, size and relative positioning of the associated substrates 4 and 5. In the illustrated example, gap 110 forms a space into which the tip portion 81 of gas sensor 6 extends, so as to measure at least one preselected characteristic of the exhaust gases flowing through exhaust treatment device 1.

Exhaust gas treatment device 1 may be made and assembled in the following manner. With reference to the maniverter 25 illustrated in FIGS. 1 and 2, inlet end cone 2 is formed in the two-piece clamshell construction discussed above, and is integrally connected with exhaust manifold 26 by means such as welding or the like. The opposite halves 35 and 36 of inlet end cone 2, along with the other components of exhaust gas treatment device 1, such as outlet end cone 3, upper housing member 7, lower housing member 13, etc., can be formed using a wide variety of different conventional manufacturing techniques, such as stamping, hydroforming, or the like.

During assembly, support mat 68 is wrapped securely about the outside surface 67 of substrate 4, and then positioned into the upper end of upper housing member 7 by means such as stuffing, or other known techniques, to assume the position illustrated in FIG. 4. In a similar fashion, substrate 5 is wrapped with support mat 74 and positioned into the lower end of lower housing member 13 to assume the position illustrated in FIG. 4. In the illustrated example, before upper and lower housing members 7, 13 are telescopingly interconnected, a wire mesh grommet 112 (FIGS. 3 and 4) is positioned in space 19 in a radially aligned relationship with apertures 12 and 18, so as to form a seal about the tip end 81 of gas sensor 6 after the same is threadedly installed in boss 105. Wire mesh grommet 112 may be spot welded to either the upper or lower housing members 7 and 13 to facilitate assembly, and serves to seal off insulating gap 19, and prevent leakage through apertures 12 and 18. Furthermore, an insulator strip or mat 113 may be positioned in space 19 with the opposite ends abutting wire mesh grommet 112. Alternatively, grommet 112 may be replaced with a circular aperture through insulator strip 113, which has its perimeter coated with a rigidizer or other similar material to protect the associated edge through which gas sensor 6 protrudes. The lower end 10 of upper housing member 7 is then telescopingly positioned within the interior 14 of lower housing member 13 so that the upper edge 100 of lower housing member 13 fits snugly against the outer surface 93 of upper housing member 7. A weld bead 114 is then formed along upper edge 100 to form an airtight seal therebetween. In the illustrated example, the lower end 91 of upper housing member 7 abuts the upper end edge of support mat 74 to form a seal that closes off space or air gap 19. However, it is to be understood that the relative positioning of lower edge 91 and lower housing member 13 is such that an effective seal for space or air gap 19 is formed without actual abutment with support mat 74. In one working embodiment of the present invention, the radially measured space between the outer surface of edge 91 and the adjacent interior surface 92 of lower housing member 13 is around one millimeter or less. Inlet end cone 2 is then attached to the upper housing member 7 in the manner described hereinabove, and a weld bead 115 is formed between the lower edge of collar 39 and the outer surface 93 of upper housing member 7 to form an airtight seal therebetween. In a similar fashion, the outlet end cone 3 is telescopingly received over the lower end 15 of lower housing member 13, and a weld bead 116 is formed along the upper edge of outer wall 52 and the outside surface 103 of lower housing member 13 to form an airtight seal therebetween.

In operation, gas sensor 38 measures selected characteristics of exhaust gases exiting manifold 26 upstream of exhaust gas treatment device 1. The exhaust gases then pass through the upper substrate 4 to treat the same, with the partially treated exhaust gases then being measured by gas sensor 6 before they pass through the lower substrate 5 and out through outlet pipe 29. Gas sensors 6 and 38 function together to diagnose the gas treatment provided by the catalysts in substrates 4 and 5 and otherwise insure proper operation of gas sensor device 1. A heat shield (not shown) may be attached to tabs 40 to provide further protection for adjacent vehicle components, along with lower heat shield 56.

In one working embodiment of the present invention, with incoming exhaust gas temperature of around 950° C., the surface temperature of exhaust gas treatment device 1 around the exterior of insulating space 19 is around 500° C., instead of around 700° C., as experienced with prior art catalytic converters without insulating space 19. Consequently, the present invention provides substantial protection to adjacent components in the vehicle engine compartment, which is particularly beneficial with respect to components made of plastic, or other similar thermally sensitive materials.

Exhaust gas treatment device 1 has a very compact configuration, and effectively insulates the exterior surface thereof, particularly at the medial portion through which the gas sensor extends, which is normally otherwise uninsulated. Exhaust gas treatment device 1 has an uncomplicated construction which is economical to manufacture and has a long operating life.

The invention claimed is as follows:

1. An exhaust gas treatment device for internal combustion engines, comprising:

an inlet end cap configured for communication with incoming exhaust gas;

an outlet end cap configured for communication with exiting exhaust gas;

first and second substrates adapted to treat exhaust gas flowing through said exhaust gas treatment device;

a cylindrically-shaped first housing member having a hollow interior receiving and retaining therein said first substrate, a first end thereof operably connected with one of said inlet end cap and said outlet end cap to form an airtight seal therebetween, and an opposite second end thereof with a radially reduced section; and a cylindrically-shaped second housing member having an interior receiving and retaining therein said second substrate, a first end thereof operably connected with the other of said inlet end cap and said outlet end cap to form an airtight seal therebetween, and an opposite second end thereof with a radially enlarged section being sized to receive said second end of said first housing member therein to form an airtight seal therebetween, whereby said reduced section of said first housing member and said enlarged section of said second housing member are spaced radially apart a predetermined distance to define therebetween an annularly-shaped space which thermally insulates an associated portion of said exhaust gas treatment device.

2. An exhaust gas treatment device as set forth in claim 1, including:

a support mat disposed between an exterior surface of said second substrate and an interior surface of said second housing member and extending around the same to support said second substrate; and wherein said reduced section has an outer edge portion thereof abuttingly engaging said first support mat to form a seal therebetween.

3. An exhaust gas treatment device as set forth in claim 1, including:

an insulator mat disposed within and extending around at least a portion of said annularly-shaped space for improved thermal insulation.

4. An exhaust gas treatment device as set forth in claim 3, including:

a first support mat disposed between an exterior surface of said second substrate and an interior surface of said second housing member and extending around the same to support said second substrate.

5. An exhaust gas treatment device as set forth in claim 4, wherein:

said reduced section has an outer edge portion thereof abuttingly engaging said first support mat to form a seal therebetween.

6. An exhaust gas treatment device as set forth in claim 5, including:

a second support mat disposed between an exterior surface of said first substrate and an interior surface of said first housing member and extending about the same to support said first substrate.

7. An exhaust gas treatment device as set forth in claim 6, wherein:

said outlet end cap has a dual wall construction defined at least in part by first and second radially spaced apart walls.

8. An exhaust gas treatment device as set forth in claim 7, including:

a second insulator mat disposed between said first and second walls of said outlet end cap.

9. An exhaust gas treatment device as set forth in claim 8, wherein:

said second wall of said outlet end cap has an edge portion thereof abuttingly engaging said first support mat to form a seal therebetween.

10. An exhaust gas treatment device as set forth in claim 9, wherein:

said inlet end cap has a single wall, clamshell construction.

11. An exhaust gas treatment device for internal combustion engines, comprising:

an inlet end cap configured for communication with incoming exhaust gas;

an outlet end cap configured for communication with exiting exhaust gas;

first and second substrates adapted to treat exhaust gas flowing through said exhaust gas treatment device;

a gas sensor adapted to measure at least one characteristic of exhaust gas flowing through said exhaust gas treatment device;

a cylindrically-shaped first housing member having a hollow interior receiving and retaining therein said first substrate, a first end thereof operably connected with said inlet end cap to form an airtight seal therebetween, and an opposite second end thereof with a radially reduced section having a first radially extending aperture configured to receive a portion of said gas sensor therethrough; and a cylindrically-shaped second housing member having an interior receiving and retaining therein said second substrate, a first end thereof operably connected with said outlet end cap to form an airtight seal therebetween, and an opposite second end thereof with a radially enlarged section having a second radially extending aperture aligned with said first aperture, and configured to receive a portion of said gas sensor therethrough; said enlarged section being sized to receive said second end of said first housing member therein to form an airtight seal therebetween, whereby said reduced section of said first housing member and said enlarged section of said second housing member are spaced radially apart a predetermined distance to define therebetween an annularly-shaped space which thermally insulates an associated portion of said exhaust gas treatment device.

12. An exhaust gas treatment device as set forth in claim 11, including:

a support mat disposed between an exterior surface of said second substrate and an interior surface of said second housing member and extending around the same to support said second substrate; and wherein said reduced section has an outer edge portion thereof abuttingly engaging said support mat to form a seal therebetween.

13. An exhaust gas treatment device as set forth in claim 11, including:

a boss rigidly connected with said enlarged section of said second housing member, and including a threaded aperture therein, which is radially aligned with said first and second apertures, and shaped to removably retain said gas sensor therein.

14. An exhaust gas treatment device as set forth in claim 11, including:

an insulator mat disposed within and extending around at least a portion of said annularly-shaped space for improved thermal insulation.

15. An exhaust gas treatment device as set forth in claim 14, including:

a first support mat disposed between an exterior surface of said second substrate and an interior surface of said second housing member and extending around the same to support said second substrate.

16. An exhaust gas treatment device as set forth in claim 15, wherein:

said reduced section has an outer edge portion thereof abuttingly engaging said first support mat to form a seal therebetween.

17. An exhaust gas treatment device as set forth in claim 16, including:

a second support mat disposed between an exterior surface of said first substrate and an interior surface of said first housing member and extending about the same to support said first substrate.

18. An exhaust gas treatment device as set forth in claim 17, including:

a boss rigidly connected with said enlarged section of said second housing member, and including a threaded aperture therein, which is radially aligned with said first and second apertures, and shaped to removably retain said gas sensor therein.

19. An exhaust gas treatment device as set forth in claim 17, including:

a weld extending between an outer edge portion of said enlarged section on said first housing member and said second end of said first housing member to define said airtight seal therebetween.

20. An exhaust gas treatment device as set forth in claim 19, wherein:

said weld defines a first weld; and including a second weld extending between an upper edge of said outlet end cap and said first end of said second housing member to define said airtight seal therebetween.

21. An exhaust gas treatment device as set forth in claim 20, including:

a third weld extending between a lower edge of said inlet end cap and said first end of said first housing member to define said airtight seal therebetween.

22. An exhaust gas treatment device as set forth in claim 21, wherein:

said outlet end cap has a dual wall construction defined at least in part by first and second radially spaced apart walls.

23. An exhaust gas treatment device as set forth in claim 22, including:

a second insulator mat disposed between said first and second walls of said outlet end cap.

24. An exhaust gas treatment device as set forth in claim 23, wherein:

said second wall of said outlet end cap has an edge portion thereof abuttingly engaging said second support mat to form a seal therebetween.

25. An exhaust gas treatment device as set forth in claim 24, wherein:

said inlet end cap has a single wall, clamshell construction.

26. An exhaust gas treatment device as set forth in claim 25, including:

an annularly-shaped insulator ring disposed in said space in a radially aligned relationship with said first and second apertures, and receiving a portion of said gas sensor therethrough to insulate the same.

27. An exhaust gas treatment device as set forth in claim 26, wherein:

said gas sensor defines a first gas sensor; and including a second gas sensor mounted on said inlet end cap, and extending into an interior portion thereof to measure at least one characteristic of exhaust gas flowing into said exhaust gas treatment device.

28. An exhaust gas treatment device as set forth in claim 27, wherein:

said inlet end cap includes an aperture configured to receive a portion of said second gas sensor therethrough.

29. An exhaust gas treatment device as set forth in claim 28, wherein:

said boss defines a first boss; and including a second boss rigidly connected with said inlet end cap, and including a threaded aperture therein, which is aligned with said aperture in said inlet end cap, and shaped to removably retain said second gas sensor therein.

30. A maniverter for vehicles having an internal combustion engine, comprising:

an exhaust manifold configured for operative connection with the internal combustion engine to route exhaust gas therefrom;

an inlet end cap operatively connected with said exhaust manifold, and communicating with incoming exhaust gas;

an outlet end cap adapted for operative connection with an exhaust pipe portion of the vehicle, and communicating with exiting exhaust gas;

first and second substrates adapted to treat exhaust gas flowing through said maniverter;

a gas sensor adapted to measure at least one characteristic of exhaust gas flowing through said maniverter;

a cylindrically-shaped first housing member having a hollow interior receiving and retaining therein said first substrate, a first end thereof operably connected with said inlet end cap to form an airtight seal therebetween, and an opposite second end thereof with a radially reduced section having a first radially extending aperture configured to receive a portion of said gas sensor therethrough; and a cylindrically-shaped second housing member having an interior receiving and retaining therein said second substrate, a first end thereof operably connected with said outlet end cap to form an airtight seal therebetween, and an opposite second end thereof with a radially enlarged section having a second radially extending aperture aligned with said first aperture, and configured to receive a portion of said gas sensor therethrough; said enlarged section being sized to receive said second end of said first housing member therein to form an airtight seal therebetween, whereby said reduced section of said first housing member and said enlarged section of said second housing member are spaced radially apart a predetermined distance to define therebetween an annularly-shaped space which thermally insulates an associated portion of said maniverter.

31. A maniverter as set forth in claim 30, including:

an insulator mat disposed within and extending around at least a portion of said annularly-shaped space for improved thermal insulation.

32. A maniverter as set forth in claim 31, including:

a first support mat disposed between an exterior surface of said second substrate and an interior surface of said second housing member and extending around the same to support said second substrate.

33. A maniverter as set forth in claim 32, wherein:

said reduced section has an outer edge portion thereof abuttingly engaging said first support mat to form a seal therebetween.

34. A maniverter as set forth in claim 33, including:

a second support mat disposed between an exterior surface of said first substrate and an interior surface of said first housing member and extending about the same to support said first substrate.

35. A maniverter as set forth in claim 34, including:

a boss rigidly connected with said enlarged section of said second housing member, and including a threaded aperture therein, which is radially aligned with said first and second apertures, and shaped to removably retain said gas sensor therein.

36. A maniverter as set forth in claim 35, wherein:

said outlet end cap has a dual wall construction defined at least in part by first and second radially spaced apart walls; and including a second insulator mat disposed between said first and second walls of said outlet end cap.

37. A maniverter as set forth in claim 36, wherein:

said second wall of said outlet end cap has an edge portion thereof abuttingly engaging said first support mat to form a seal therebetween.

38. A maniverter as set forth in claim 37, wherein:

said inlet end cap has a single wall, clamshell construction.

39. A maniverter as set forth in claim 38, including:

an annularly-shaped insulator ring disposed in said space in a radially aligned relationship with said first and second apertures, and receiving a portion of said gas sensor therethrough to insulate the same.

40. An exhaust gas treatment device for internal combustion engines, comprising:

an inlet end cap configured for communication with incoming exhaust gas;

an outlet end cap configured for communication with exiting exhaust gas;

first and second substrates adapted to treat exhaust gas flowing through said exhaust gas treatment device;

a gas sensor adapted to measure at least one characteristic of exhaust gas flowing through said exhaust gas treatment device;

a cylindrically-shaped first housing member having a hollow interior receiving and retaining therein said first substrate, a first end thereof operably connected with one of said inlet end cap and said outlet end cap to form an airtight seal therebetween, and an opposite second end thereof with a radially reduced section having a first radially extending aperture configured to receive a portion of said gas sensor therethrough; and a cylindrically-shaped second housing member having an interior receiving and retaining therein said second substrate, a first end thereof operably connected with the other of said inlet end cap and said outlet end cap to form an airtight seal therebetween, and an opposite second end thereof with a radially enlarged section having a second radially extending aperture aligned with said first aperture, and configured to receive a portion of said gas sensor therethrough; said enlarged section being sized to receive said second end of said first housing member therein to form an airtight seal therebetween, whereby said reduced section of said first housing member and said enlarged section of said second housing member are spaced radially apart a predetermined distance to define therebetween an annularly-shaped space which thermally insulates an associated portion of said exhaust gas treatment device.

41. An exhaust gas treatment device as set forth in claim 40, including:

an insulator mat disposed within and extending around at least a portion of said annularly-shaped space for improved thermal insulation.

42. An exhaust gas treatment device as set forth in claim 41, including:

a first support mat disposed between an exterior surface of said second substrate and an interior surface of said second housing member and extending around the same to support said second substrate.

43. An exhaust gas treatment device as set forth in claim 42, wherein:

said reduced section has an outer edge portion thereof disposed adjacent to said first support mat to at least partially close off said annularly-shaped space.

44. An exhaust gas treatment device as set forth in claim 43, including:

a second support mat disposed between an exterior surface of said first substrate and an interior surface of said first housing member and extending about the same to support said first substrate.

45. An exhaust gas treatment device as set forth in claim 44, including:

a boss rigidly connected with said enlarged section of said second housing member, and including a threaded aperture therein, which is radially aligned with said first and second apertures, and shaped to removably retain said gas sensor therein.

46. A maniverter for vehicles having an internal combustion engine, comprising:

an exhaust manifold configured for operative connection with the internal combustion engine to route exhaust gas therefrom;

an inlet end cap operatively connected with said exhaust manifold, and communicating with incoming exhaust gas;

an outlet end cap adapted for operative connection with an exhaust pipe portion of the vehicle, and communicating with exiting exhaust gas;

first and second substrates adapted to treat exhaust gas flowing through said maniverter;

a gas sensor adapted to measure at least one characteristic of exhaust gas flowing through said maniverter;

a cylindrically-shaped first housing member having a hollow interior receiving and retaining therein said first substrate, a first end thereof operably connected with one of said inlet end cap and said outlet end cap to form an airtight seal therebetween, and an opposite second end thereof with a radially reduced section having a first radially extending aperture configured to receive a portion of said gas sensor therethrough; and a cylindrically-shaped second housing member having an interior receiving and retaining therein said second substrate, a first end thereof operably connected with the other of said inlet end cap and said outlet end cap to form an airtight seal therebetween, and an opposite second end thereof with a radially enlarged section having a second radially extending aperture aligned with said first aperture, and configured to receive a portion of said gas sensor therethrough; said enlarged section being sized to receive said second end of said first housing member therein to form an airtight seal therebetween, whereby said reduced section of said first housing member and said enlarged section of said second housing member are spaced radially apart a predetermined distance to define therebetween an annularly-shaped space which thermally insulates an associated portion of said maniverter.

47. A maniverter as set forth in claim 46, including:

an insulator mat disposed within and extending around at least a portion of said annularly-shaped space for improved thermal insulation.

48. A maniverter as set forth in claim 47, including:

a first support mat disposed between an exterior surface of said second substrate and an interior surface of said second housing member and extending around the same to support said second substrate.

49. A maniverter as set forth in claim 48, wherein:

said reduced section has an outer edge portion thereof disposed adjacent to said first support mat to at least partially close off said annularly-shaped space.

50. A maniverter as set forth in claim 49, including:

a second support mat disposed between an exterior surface of said first substrate and an interior surface of said first housing member and extending about the same to support said first substrate.

51. A maniverter as set forth in claim 50, including:

a boss rigidly connected with said enlarged section of said second housing member, and including a threaded aperture therein, which is radially aligned with said first and second apertures, and shaped to removably retain said gas sensor therein.

* * * * *